US005358258A

United States Patent [19]

Killion

[11] Patent Number: 5,358,258

[45] Date of Patent: Oct. 25, 1994

[54] APPARATUS FOR SOCCER TRAINING

[76] Inventor: Darryl Killion, 830 W. Almond St., Orange, Calif. 92668

[21] Appl. No.: 192,295

[22] Filed: Feb. 4, 1994

[51] Int. Cl.[5] ..... A63B 67/10

[52] U.S. Cl. ..... 273/414; 273/58 C; 273/DIG. 19; 273/DIG. 30; 273/29 A

[58] Field of Search ..... 273/413, 414, 58 C, 273/1.5 A, 26 E, 29 A, 200 R, DIG. 19, DIG. 30

[56] References Cited

U.S. PATENT DOCUMENTS

| | | | |
|---|---|---|---|
| 4,071,241 | 1/1978 | Cortes Garcia | 273/414 X |
| 4,147,353 | 4/1979 | Moore | 273/413 |
| 4,307,888 | 12/1981 | Ohle | 273/413 |
| 4,687,209 | 8/1987 | Carey | 273/414 X |
| 5,083,797 | 1/1992 | Vartija et al. | 273/414 |
| 5,094,462 | 3/1992 | Boyle et al. | 273/414 |

*Primary Examiner*—Vincent Millin
*Assistant Examiner*—Raleigh W. Chiu
*Attorney, Agent, or Firm*—Macro-Search Corp.

[57] ABSTRACT

A soccer training device is described that attaches a soccer ball to a user through a flexible tether line. An adjustable belt encircles the waist of the user and attaches to one end of the elastic tether line. The other end of the tether line is attached to a girdle made of elastic sheet material that encircles the soccer ball. Certain features of the girdle allow it to hold the ball firmly while, simultaneously, provide proper tactile feedback to the user when kicking the ball. Several novel soccer training exercises useful with the present invention are described.

6 Claims, 2 Drawing Sheets

APPARATUS FOR SOCCER TRAINING

FIELD OF THE INVENTION

This invention relates generally to athletic training devices and, more particularly, describes a soccer training device for tethering a soccer ball to an individual.

BACKGROUND OF THE INVENTION

Proficient play of the game of soccer or other ball kicking or striking sports requires certain skills on the part of each player. These skills include the ability to properly and accurately kick or strike the ball, control an incoming perhaps spinning or bouncing ball, and the like. Many of these skills are taught at practice sessions where team members gather to perform various skill training "drills" or exercises administered by a team coach or trainer. In the game of soccer, such exercises may including kicking exercises, where players each in turn kick a ball towards a target; fielding exercises, where each player must quickly bring under control an incoming ball which may be bouncing, rolling, spinning, and so forth.

While these training exercises are certainly useful, there are several prominent drawbacks associated with them. Primarily, any kicked soccer ball, if it isn't trapped in the goal by a goal net or otherwise controlled, must be retrieved in order to be available for use again. This is one reason why multiple soccer balls must be purchased and used at practice sessions. Soccer balls are expensive, and if they are not retrieved immediately they may be lost or stolen.

Another drawback to such practice sessions is that many of the drills require more than one person, for example, kicking a ball back and forth between two or more players. An individual cannot perform many of these useful drills alone. Further, such exercises are not usually effective for building quick reflexes and endurance since they only require periodic, non-continuous action.

Clearly, then, there is a need for a soccer training device that can be used by an individual at any time, without requiring the presence of other team members. Such a device would allow more practice of kicking and controlling the ball in any given period of time than conventional team training methods, and would not require retrieving kicked soccer balls.

Further, such a needed device would be relatively easy to manufacture, use, and maintain, and allowing exercises not currently possible. The present invention fulfills these needs and provides further related advantages.

SUMMARY OF THE INVENTION

The present invention is a soccer training device that effectively attaches a soccer ball to a user through a flexible tether line. An adjustable belt encircles the waist of the user and attaches to one end of the elastic tether line. The other end of the tether line is attached to a girdle made of elastic sheet material that encircles the soccer ball. Certain features of the girdle allow it to hold the ball firmly while, simultaneously, provide proper tactile feedback to the user when kicking the ball.

The present invention has certain advantages over existing training methods. First, the tether line results in relatively quick return of the soccer ball to the user after the ball has been kicked, and as such builds quick reflexes and endurance through repeated use. The present invention can be used in many different ways for building different skills. For example, kicking the ball upward results in the tether line pulling the ball back into the ground for providing a large bounce. Repetition of this exercise trains the user to field incoming, bouncing balls. Other exercises can be used to training a user to spin the ball when kicking, controlling an incoming, spinning ball, alternately kicking the ball with each foot, and so forth.

The present invention is a versatile training device that can be used by an individual at any time, not just during formal practice sessions. The user of such a device does not have to chase after a ball that has just been kicked, thereby allowing more practice of kicking the ball in any given period of time. Further, the present device is easily cleaned, relatively simple to manufacture, use, and maintain, and provides for training exercises never before possible. Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
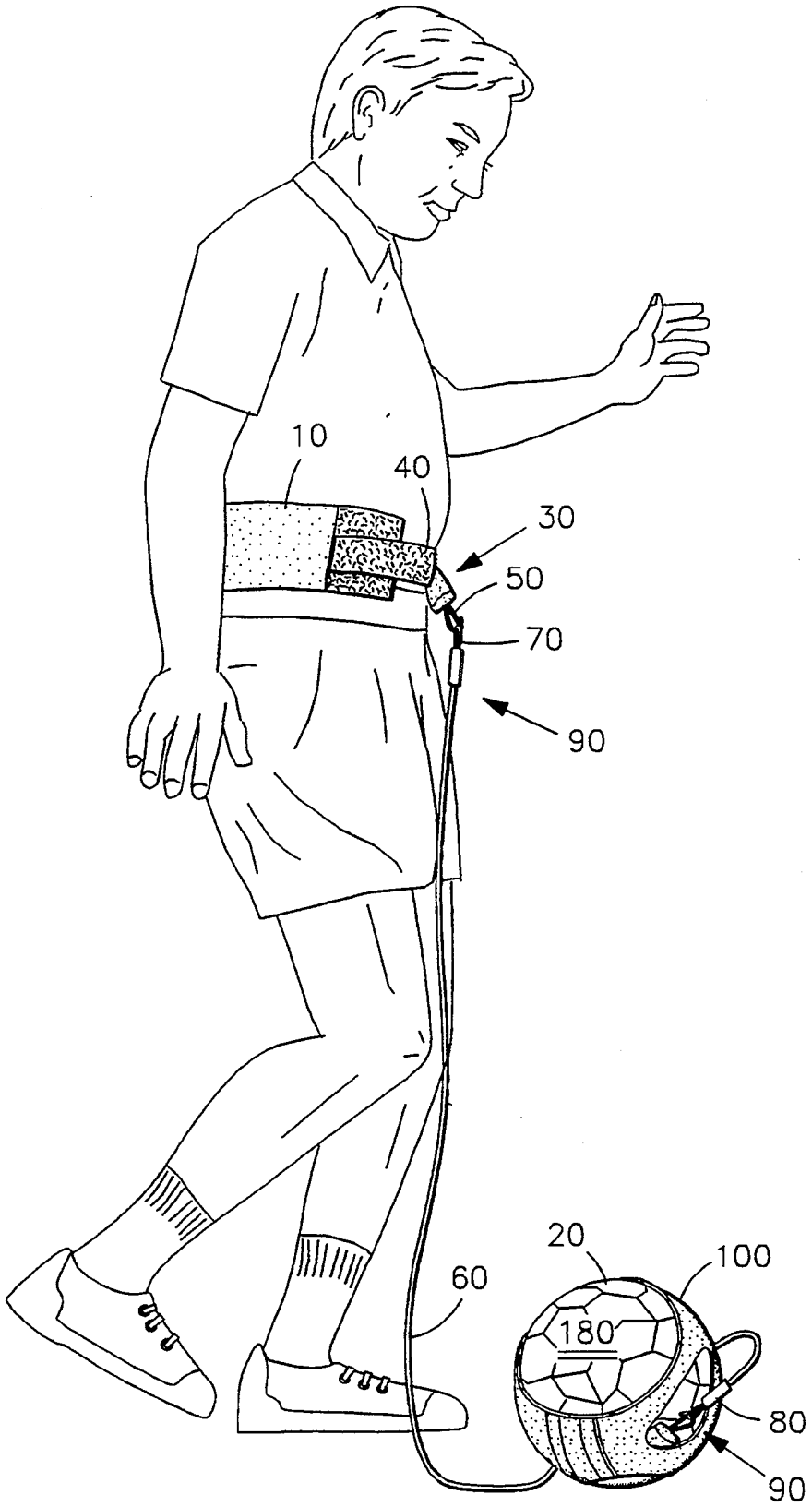
FIG. 1 is a perspective illustration of the invention, illustrating a soccer training device as attached to a user about to kick a soccer ball that is encircled with a flexible girdle of the device.

FIG. 1 shows an apparatus for soccer training. A flexible, non-elastic belt 10 that encircles a waist 30 of a user includes a fixing means 40, such as a hook and loop type fastener, for fixing the belt 10 to the user. Such a fixing means 40 is adjustable so as to accommodate a variety of waist sizes. A first attachment means 50, such as a spring-loaded clip, extends from the belt 10 away from the user.

A tether line 60 is made of an elastic material which lengthens under tensile forces on the line 60, and thereafter contracts due to elastic resilience of the material. The line 60 includes a second attachment means 70 and a third attachment means 80 fixed at opposing ends 90 of the line 60 respectively. The second attachment means 70 cooperates with the first attachment means 50 of the belt. For example, in the embodiment wherein the first attachment means 50 is a spring-loaded clip, the second attachment means 70 may be a portion of the tether line 60 formed into a loop for engaging the spring-loaded clip. Clearly, other alternate cooperative attachment means 50,70 may be readily used by those skilled in the art. Further, the tether line 60 may include a length adjustment means (not shown), such as a buckle arrangement that allows the tether line 60 to be set at various lengths.

Figure 2:
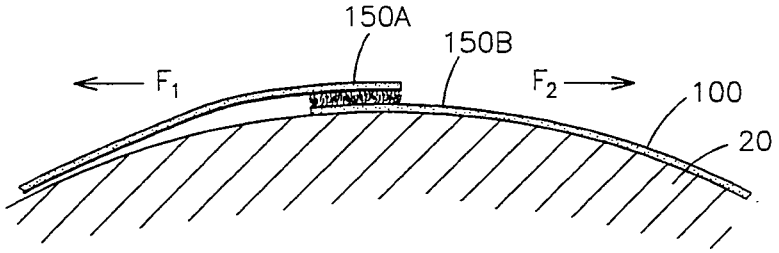
FIG. 2 is a partial cross sectional view of the invention, illustrating a means for securing the girdle around the soccer ball.
Figure 4:
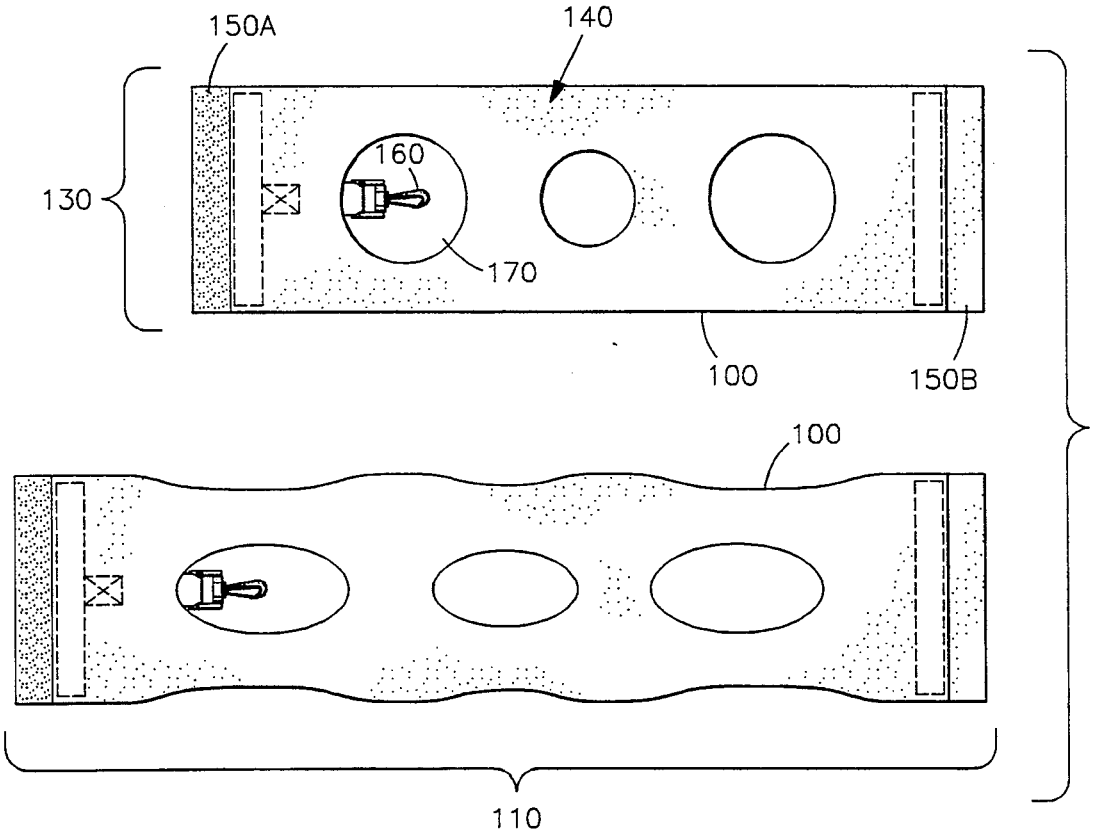
FIG. 4 is a top plan view of the invention, illustrating the girdle of the invention in both a stretched and non-stretched condition.

A girdle 100 is made from resilient elastic sheet material of a length 110 sufficient for substantially a soccer ball 20 when the girdle 100 is in a stretched state. Further, the girdle 100 is of a width 130 such that opposing lateral portions 140 of the girdle 100 completely encircle the ball 20 so as to secure the ball 20 within the girdle 100 (FIGS. 1 and 4). A hook and loop type fastener material affixed to the longitudinal ends of the girdle 100 and extending the full width 130 of the girdle 100 serves as a securing means 150A,150B for securing the girdle 100 firmly around the ball 20 (FIGS. 2 and 4). The securing means 150A,150B extends the full width 130 of the girdle 100 so that the tensile force of stretching of the girdle 100 around the ball 20 is uniformly distributed across the full width 130 of the girdle 100. An inside surface 190 of the girdle 100 that contacts an exterior surface 180 of the ball 20 is of a rough or otherwise high-friction nature for improved gripping of the girdle 100 onto the surface 180 of the ball 20 (FIG. 31). A fourth attachment means 160, such as a spring-loaded clip, extends away from the girdle 100.

Figure 3:
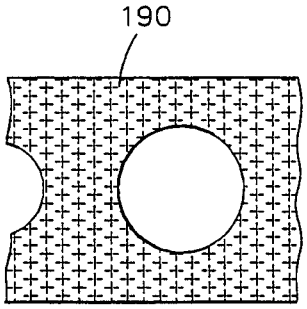
FIG. 3 is a partial bottom plan view of the invention, illustrating a rough inside surface of the girdle for making contact with an external surface of the soccer ball.

In one embodiment of the invention, the girdle 100 provides at least one aperture 170 in the sheet material, such as a plurality of round holes approximately centered between the lateral margins or portions 140 (FIGS. 3 and 4). As such, the tensile forces of the stretching of the girdle 100 around the ball 20 are distributed to the lateral portions 140, providing an improved holding power or ability of the girdle 100 on the ball 20. A further advantage of the at least one aperture 170 is that access to the exterior surface 180 of the ball 20 is provided to the user for a more realistic tactile feedback to the user when kicking the ball 20.

In use, the first attachment means 50 of the belt 10 is attached to the second attachment means 70 of the tether line 60, and the third attachment means 80 of the tether line 60 is attached to the fourth attachment means 160 of the girdle 100. The belt 10 is fixed around the waist 30 of the user. The ball 20 is positioned in front of the user for receiving kicking blows by the user, whereupon the ball 20 is propelled away from the user. The belt 10 and the fixing means 40 are strong enough to transmit the tension in the tether line 60 to the waist 30 of the user without stretching or breaking. The natural resiliency of the tether line 60 returns the ball 20 to the front of the user in each case for cyclic, repetitive practice in kicking the ball 20 by the user.

The present invention can be used in a variety of advantageous ways for teaching certain skills useful in the game of soccer. For example, in an embodiment of the invention wherein the length of the tether line 60 is about four feet, the user may position himself some further distance, such as eight feet, from a wall or other stationary object (not shown). In training for strong, power kicks and for strengthening exercises, the user tries to kick the ball 20 with enough force so that the ball at least touches the wall.

Other exercises that are particularly useful and not easily accomplished with other training devices include rapid speed exercises, where the ball 20 is maintained off of the ground by rapid kicking, optionally with alternating feet. Another exercise comprises the steps of kicking the ball 120 upward so that the tether line 60 pulls the ball 20 back into the ground with some force, thereby causing the ball 20 to bounce. Such an exercise is excellent for training the user to properly "trap" or control the incoming, bouncing ball 20. Other skills can be taught in an accelerated manner, such as imparting a rotational spin on the ball 20 when kicking same, controlling rapidly spinning balls 120, and the like. As these exercises result in rapid return of the soccer ball 20 to the user, the user builds quickness, reflex, and endurance more effectively than with other training methods.

The present invention, while having been described for use with a soccer ball and for providing training for skills associated with the game of soccer, may certainly be readily adapted to other sports by those skilled in the art. Such other sports might include tennis or other racquet sports, volleyball, American football, and the like. Clearly, many types of sports require endurance and quick reflexes, and the present invention is particularly well suited for training in these areas. The present invention can be readily adapted for use with other types of physically manipulated sporting equipment, such as volleyballs, tennis balls, footballs, badminton birdies, and the like. Thus, while the invention has been described with reference to a preferred embodiment, it is to be clearly understood by those skilled in the art that the invention is not limited thereto. Rather, the scope of the invention is to be interpreted only in conjunction with the appended claims.

What is claimed is:

1. Apparatus for soccer training comprising:

a belt of a length adapted for encircling a waist of a user, a means for fixing the belt to the user, and further including a first attachment means extending away from the user;

a tether line made of an elastic material, the line adapted for lengthening under tensile forces on the line, and thereafter contracting due to elastic resilience of the material, the line including second and third attachment means fixed at opposing ends of the line respectively; and a girdle of a resilient elastic sheet material of a length adapted for encircling a soccer ball when the girdle is in a stretched condition, and having a width sufficient to secure the ball within the girdle, opposing lateral portions of the girdle wrapping around the ball, the girdle including securing means at longitudinal ends thereof for securing the girdle around the ball, and a fourth attachment means extending from the girdle;

whereby with the line interconnecting the belt with the girdle; the first and second, and the third and fourth attachment means each being mutually engaged respectively, the ball being positioned in front of the user, blows delivered to the ball by the user result in the ball being propelled away from the user, the natural resiliency of the line returning the ball to the front of the user in each case for cyclic, repetitive practice in striking the ball by the user.

2. The apparatus of claim 1 wherein the girdle provides at least one aperture in the sheet material approximately centered between the lateral portions, such that tensile forces of the stretching of the girdle around the ball are distributed to the lateral portions thereby improving the holding power of the girdle on the ball, the at least one aperture providing access to an exterior surface of the ball.

3. The apparatus of claim 2 wherein the at least one aperture is, with the girdle in the non-stretched condition, a round hole.

4. The apparatus of claim 1 wherein the fourth attachment means is positioned on the girdle such that forces exerted by the line on the girdle are mainly tangential to the external surface of the ball.

5. The apparatus of claim 1 wherein the girdle includes an inside surface for contact with the surface of the ball, the inside surface being of a rough nature for improved gripping of the girdle onto the surface of the ball.

6. The apparatus of claim 1 wherein the securing means is hook and loop fastener material affixed to the longitudinal ends of the girdle and extending the full width of the girdle so that the tensile force of stretching of the girdle is uniformly distributed across said full width.

* * * * *